United States Patent [19]

Carty

[11] Patent Number: 4,486,984

[45] Date of Patent: Dec. 11, 1984

[54] METHOD FOR CONSTRUCTION OF A PRECAST CHIMNEY

[76] Inventor: John J. Carty, 2 Model Ct., Rocky Point, N.Y. 11778

[21] Appl. No.: 423,163

[22] Filed: Sep. 24, 1982

[51] Int. Cl.[3] ..... E04H 12/28

[52] U.S. Cl. ..... 52/125.5; 52/218

[58] Field of Search ..... 52/218, 219, 125.5, 52/227, 124.2, 295, 228, 224; 98/58

[56] References Cited

U.S. PATENT DOCUMENTS

| | | | |
|---|---|---|---|
| 335,451 | 2/1886 | Hassard | 52/124.2 |
| 859,616 | 7/1907 | Repetto | 52/218 |
| 2,011,018 | 8/1935 | Smith | 52/295 |
| 2,971,295 | 2/1961 | Reynolds | 52/228 |
| 3,962,088 | 6/1976 | Kuhlenschmidt et al. | 52/227 |

FOREIGN PATENT DOCUMENTS

| | | | |
|---|---|---|---|
| 2558623 | 7/1977 | Fed. Rep. of Germany | 52/218 |
| 527552 | 10/1921 | France | 52/227 |
| 1062502 | 12/1953 | France | 52/227 |
| 1314337 | 4/1973 | United Kingdom | 98/58 |

*Primary Examiner*—James L. Ridgill, Jr.

[57] ABSTRACT

This invention relates to an improved design associated with the fabrication and construction of a chimney stack or other structures of extreme height such as towers, masts, and the like, wherein precast sections are utilized having reinforcing steel members positioned therein so as to permit upon stacking of said precast sections, vertical alignment thereof such that said reinforcing steel members are positioned in vertical alignment throughout the height of the chimney so as to achieve optimum structural integrity. Additionally, the invention herein utilizes the reinforcing steel members to facilitate the movement of said precast sections of said chimney by use of threaded eye bolts which are easily detachable from the steel reinforcing members once the precast sections of said chimney have been lifted and aligned in place.

11 Claims, 10 Drawing Figures

METHOD FOR CONSTRUCTION OF A PRECAST CHIMNEY

BACKGROUND AND OBJECTS OF THE INVENTION

The present invention relates to a generally new and improved design associated with the fabrication and construction of a chimney stack capable of conveying hot gases generated in conjunction with industrial applications to a height within the atmosphere sufficient to meet current pollution standards.

In conjunction therewith and prior to the present invention, industrial chimneys were known, but not of a design nor method of construction which lended themselves to the advantages and overall efficiencies achievable in conjunction with the present invention.

More particularly, although it is known in the prior art to construct an industrial chimney by use of a precast system as disclosed and claimed in U.S. Pat. No. 4,104,868, issued on Aug. 8, 1978, to Kenneth Roy Jackson of Aylesford, Near Maidstone, England, same being representative of the state of the prior art to date, said prior art neither teaches nor discloses the present invention which improves upon the many disadvantages associated therewith.

More particularly, by utilization of the invention herein disclosed, there is the ability to fabricate precast sections of a chimney which are capable of being assembled at the construction sight such that the reinforcing steel members utilized within said precast sections are positioned during fabrication of said precast sections at exact locations therein and thus capable of providing optimum structural support when said sections are assembled according to the overall design of said chimney.

It is in the context of the above that one of the primary objectives of the present invention is to create a new and improved design associated with the fabrication and construction of a chimney stack capable of conveying hot gases generated in conjunction with industrial applications to a height within the atmosphere sufficient to meet current pollution standards that overcomes problems currently existing in the prior art.

It is another object of this invention to create a new and improved design associated with the fabrication and construction of a chimney stack whose design permits the prefabrication of individual sections which are then capable of being assembled at the building location in a predesigned stacked arrangement so as to facilitate the assembly and construction of the chimney stack in question.

It is another object of this invention to create a new and improved design associated with the fabrication and construction of a chimney stack wherein there is positioned within each precast section of said chimney stack reinforcing members whose positioning within each section is such so as to provide vertical alignment throughout the entire height of said chimney stack between all of the reinforcing members positioned in the respective precast sections once said chimney stack is fully assembled thus achieving optimum structural support.

It is another object of this invention to create a new and improved design associated with the fabrication and construction of a chimney stack wherein said reinforcing members utilized in each precast section can either be under pre-tension stress or post-tension stress or combinations thereof so as to achieve optimum structural support utilizing the minimum of supporting members.

It is another object of this invention to create a new and improved design associated with the fabrication and construction of a chimney stack wherein there is the ability to achieve the ultimate in quality control with regard to the fabrication of a chimney stack since each precast section of said chimney stack can be examined prior to utilization in the fabrication of the overall chimney stack for defects such as improper location of reinforcing members as to alignment within the precast structure and the like.

It is another object of this invention to create a new and improved design associated with the fabrication and construction of a chimney stack wherein reinforcing members are utilized by having their exposed portions threaded so as to be capable of receiving an interlocking eye bolt which can be readily threaded on to or threaded off of said exposed section of said structural members thereby providing means to permit the lifing and otherwise moving of said precast sections so as to facilitate loading, transportation and assembly of said precast sections.

It is another object of this invention to create a new and improved design associated with the fabrication and construction of a chimney stack wherein there is the ability to maintain in the asembly process of assembling said precast sections into an overall chimney, adjustments in the vertical positioning of each precast section so as to achieve optimum vertical alignment in the construction of the overall chimney.

It is another object of this invention to create a new and improved design associated with the fabrication and construction of a chimney stack whose method of fabrication, to wit, utilization of precast sections, provides an economy of design and fabrication capable of achieving the overall construction of a chimney stack whose design and structural integrity is superior to that known within the prior art but which economy is cost of construction and fabrication far exceeds comparable designs and techniques presently available in the prior art.

It is another object of this invention to create a new and improved design associated with the fabrication and construction of a chimney stack wherein there is provided the ability to extend the height of the chimney stack after its initial construction and utilization so as to meet increased operating loads or new environmental criteria without requiring the shutdown of the chimney stack's operation to achieve same.

The objects and advantages of the invention are set forth in part herein and in part will be obvious herefrom or may be learned by the practice of the invention, the same being realized and attained by means of the instrumentalities and combinations pointed out in the appended claims.

The invention consists in the novel parts, constructions, arrangements, combinations and improvements herein shown and described.

SUMMARY OF THE INVENTION

Briefly described, the present invention is directed to a new and improved design associated with the fabrication and construction of a chimney stack or other structures of extreme height such as towers, masts, and the like, wherein precast sections are utilized having reinforcing steel members positioned therein so as to permit upon stacking of said precast sections, vertical alignment thereof such that said reinforcing steel members are positioned in vertical alignment throughout the height of the chimney stack so as to achieve optimum structural integrity.

The above is achieved by having each precast section constructed such that within each precast section of said chimney stack, structural support members are positioned therein according to a predesigned array, said structural support members' lower portion extending beyond the lower portion of said precast section a predetermined length, there additionally being fabricated within said precast sections, recesses about each of said structural support members' upper portion, said recesses exposing the upper portions of said structural support members as embedded within the precast sections, such that the upper portions of said structural support members extend into the opening defined by said recesses. The depth of said recesses equates to the length associated with that portion of said structural support member that extends beyond the bottom of said precast section plus that portion of the upper portion of said structural support members exposed within said recesses. Upon the placement of one precast section upon another, and in keeping with the invention, the portions of the structural support members extending below the bottom of the upper precast section fit into the recesses appearing within the upper portion of the lower precast section, and in direct vertical alignment with the upper portions of the structural support members extending into said recesses of said lower precast section as well as in direct physical contact therewith thus providing precise alignment between the sections' respective reinforcing members so as to achieve optimum structural support.

Additionally, the size of the recess openings within a precast section that exists in conjunction with each of the structural support members positioned therein is of a size sufficient to permit the insertion of an eye bolt.

Furthermore, the depth of said recess openings are such so that a portion of said structural support member protrudes into said recess opening and has said protruding portion threaded so as to mechanically receive in a threaded fashion said eye bolt, said arrangement providing an efficient means to assist in the lifting, transporting and assembly of each of said precast sections simply by having mechanically threaded onto said supporting members of an eye bolt which provides a mechanical configuration capable of receiving a hook or cable, or the like which can then be utilized as well known within the prior art in association with a lifting device such as a crane, to achieve lifting, movement and/or transportation of said precast sections. When the need to further move said precast section no longer exists, the eye bolts can be disengaged from said structural support members leaving the structural support members available to receive and otherwise interface with adjacent precast sections in the manner as herein set forth.

In further keeping with the invention, there is provided to facilitate alignment of said precast sections during construction, as well as to provide additional structural integrity at the point of meeting between the respective structural support members of two adjacent precast sections, guide members affixed to the perimeter of the extended portions of the structural support members protruding beneath the bottom of a precast section, said guide members extending beyond the length of the bottom of said structural support members a distance sufficient so as to facilitate aligning said structural support members with the structural support members protruding within the recess openings appearing within the top portion of a lower precast section.

In the overall construction of a chimney stack done in accordance with this invention, precast sections will be fabricated at a location wherein the placement of reinforcing members can be achieved under controlled conditions and quality control measures taken to insure exact spacing and alignments of said structural support members within said precast sections, whereupon, said precast sections will then be transported to the construction location where a chimney stack is to be fabricated and said sections are then, according to the overall design of the chimney stack, lifted and placed one on top of each other so as to fabricate the chimney stack in question, same having their respective structural support members aligned as herein provided, there then being injected into the spacings between said sections and within the recess openings housing the upper exposed portion of said structural support members, pressurized or unpressurized mortar, capable of bonding the sections to each other as is well known within the prior art, therebeing utilized well known means such as sealers around the seam between said respective sections so as to contain therein said mortar until same hardens.

Additionally, it is within the scope of this invention to be able to place, as needed, between the seams created by placing one precast section on top of another, shims, so as to adjust the vertical alignment of each precast section as they are placed one on top of the other in the construction of the overall chimney stack, thereby achieving the optimum vertical alignment of the overall chimney stack.

It will be understood that the foregoing general description and the following detailed description as well are exemplary and explanatory of the invention, but are not restrictive thereof.

The accompanying drawings referred to herein and constituting a part hereof, are illustrative of the invention but not restrictive thereof, and, together with the description, serve to explain the principles of the invention.

DESCRIPTION OF A PREFERRED EMBODIMENT

Figure 1:
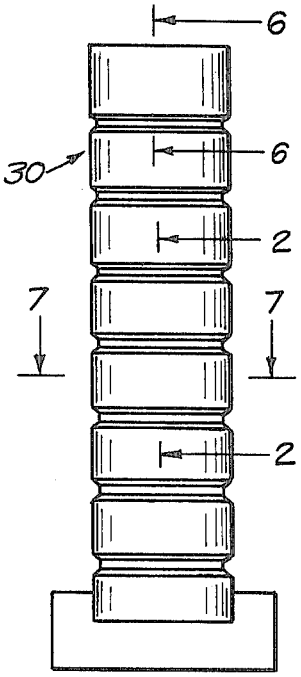
FIG. 1 is a front elevational view of a chimney stack constructed in accordance with the invention.

Referring now more particularly to the embodiment of the above invention illustrated in the accompanying drawings, there is illustrated in FIG. 1, a chimney stack fabricated and constructed in accordance with the instant invention and indicated generally by reference numeral 30.

Figure 2:
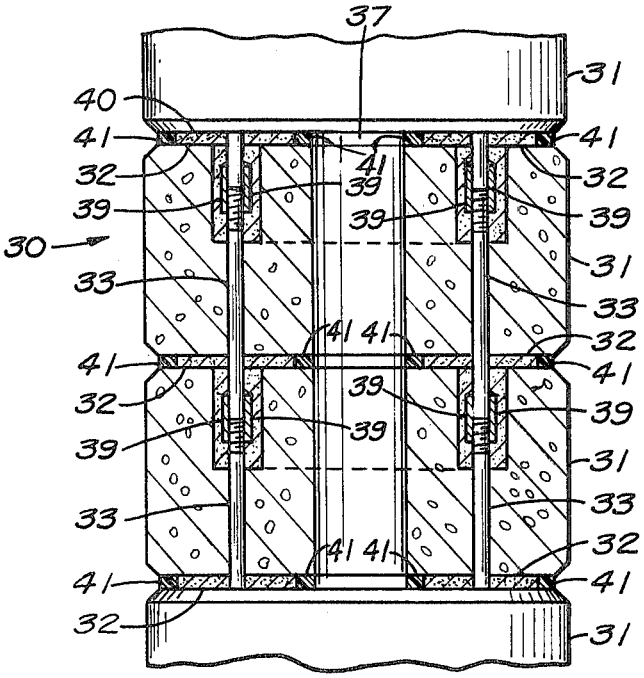
FIG. 2 is an enlarged partial vertical section of the chimney stack illustrated in FIG. 1 and taken along lines 2—2 illustrating the interrelationship between precast sections of the overall chimney stack.

In accordance with the invention and as illustrated in FIG. 2, chimney stack 30 is fabricated from separate and distinct precast sections 31, said precast sections 31 being stacked one on top of another in a structural interfit relationship inherent to the invention as herein set forth. By the utilization of pressurized mortar 32, means are provided for structurally affixing one precast section 31 to another.

Figure 3:
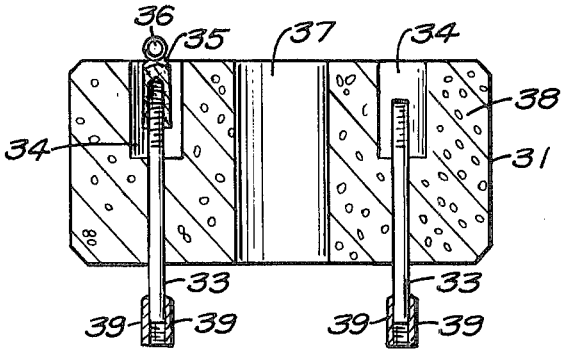
FIG. 3 is an enlarged vertical sectional view of one precast section of a chimney stack constructed in accordance with the invention.

Reference is now herein made to FIG. 3 wherein there is illustrated a cross sectional view of a single precast section 31 utilized and fabricated in accordance with the invention. As therein illustrated, precast section 31 is fabricated in accordance with the prior art technology existing to date as related to concrete prefabrication techniques, the composition of material utilized in fabricating precast section 31 being from, as herein preferrably embodied, Portland Cement in an acceptable design mix for concrete structures as is available in the prior art.

As illustrated in FIG. 3, structural support members 33 are placed within precast section 31 according to a predetermined design associated with achieving the optimum resistance to the various stresses associated with the intended utilization of the chimney stack. As herein preferrably embodied, structural support members 33 are fashioned from steel rods although said structural support members 33 can be fashioned from any type of material known within the prior art capable of meeting the design criteria associated with the particular use to which chimney stack 30 is intended, nothing herein contained to be interpreted to so restrict the invention to only being able to utilize steel as the material from which structural support members 33 could be fashioned. It should be further noted that although rods are mentioned as the shape to be utilized with regard to the structural support members 33 in the preferred embodiment of the invention, nothing herein contained should be interpreted to so limit the invention, it being with the scope of this invention for structural support members 33 to be of any form or shape, such as an "I" beam, a bar whose cross section is square, rectangular, hexagonal and the like.

Figure 4:
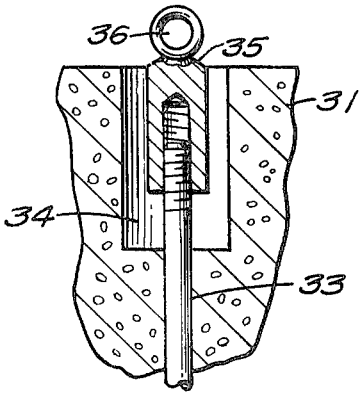
FIG. 4 is an enlarged partial vertical sectional view of a portion of the chimney stack illustrated in FIG. 3.

As further illustrated in FIG. 4, the upper portion of structural support members 33 are threaded and protrude into recessed cavities 34 formed within the upper portion of precast sections 31 so as to readily enable the threading thereon as well as disengagement therefrom of eye bolt 35. By so doing, there is achieved a means that facilitates the movement of precast sections 31, be it related to the transportation thereof or the actual assembly of precast sections 31 at the construction site. By use of a threaded eye bolt 35, same being readily available in the prior art, and by threading said eye bolts on to the exposed threaded portions of structural support members 33, as same protrudes within cavity 34 of precast sections 31, means are provided for either use of lifting cable to be threaded through the eye opening 36 of eye bolt 35 or the use of a "hook" arrangement, either of which to then be utilized in connection with a lifting crane or the like, there thus being achieved the ability to readily move said precase sections 31. Once a precast section 31 has been placed into its predetermined assembled postion on top of another precast section 31, in accordance with the overall design criteria of chimney stack 30 which is being constructed, threaded eye bolts 35 are then unthreaded from the engaged portion of structural support members 33, thus leaving cavity 34, with that portion of structural support members 33 protruding into the cavity area as hereinbefore discussed and as depicted in FIG. 3 of the drawings, in position to receive, in accordance with the invention, the next precast section 31 that is to fit on top of the recently positioned precast section 31 in accordance with this invention. As herein set forth, there thus becomes inherent in the design and structural interrelationship of precast sections 31 with each other, a means that takes advantage of said structural design to additionally facilitate the handling, movement, transportation and positioning of the precast sections 31 by use of threaded eye bolts 35 as hereinbefore set forth.

Reference again is herein made to FIG. 3 which sets forth an enlarged vertical sectional view of one precast section 31 constructed in accordance with the invention. As therein depicted, precast section 31 has appearing through its center portion flue shaft 37 formed within the central area of precast section 31, the composition of precast section 31 evidenced by the walls 38 of precast section 31 being fabricated as hereinabove set forth in the preferred embodiment as herein described from an acceptable design mix of Portland cement as related to concrete structures. In keeping with the invention, precast sections 31 are designed so that upon the placement of one on top of each other they interfit and otherwise align themselves such that flue shaft 37 becomes an air tight interior opening throughout the entire height of chimney stack 30 capable of conducting gases and other industrial exhausts throughout the entire height of chimney stack 30 in accordance with the invention.

As further depicted in FIG. 3, portions of structural support members 33 protrude beneath the lower portion of precast sections 31 and there is affixed to said protruding portion of structural support members 33, coupling bars 39, coupling bars 39 being structurally affixed to structural support members 33 as depicted in FIG. 3. The utilization of coupling bars 39, as hereinabove set forth, and in keeping with the invention provides for the precise alignment in accordance with the overall design criteria associated with the particular design of a chimney stack under construction of the respective interlocking precast sections 31 as they are assembled at the construction site after being fabricated at the particular plant location.

Figure 5:
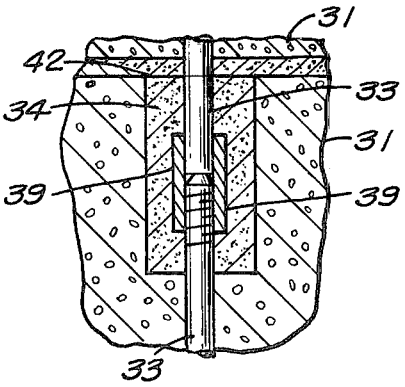
FIG. 5 is an enlarged partial vertical sectional view of a portion of the chimney stack illustrated in FIG. 2.

The above is accomplished as depicted in FIG. 5 which illustrates an enlarged partial vertical sectional view of FIG. 2 highlighting the interfit in accordance with the invention between the structural support members 33 of one precast section 31 with the structural support members 33 of an adjacent precast section 31.

With regard to the above, and as illustrated in FIG. 5, structural support member 33 of precast sections 31 depicts in recess 34 thereof, the protrusion into cavity 34 of the upper threaded portion of structural support member 33 positioned therein as hereinbefore set forth in accordance with the invention. Structural support member 33', which protrudes from the lower portion of the precast sections 31 that is placed on top of the precast section 31 depicted in FIG. 5, interfits with as well as being in direct structural contact with the upper threaded portion of structural support member 33, same being in accordance with the invention, the above interfit relationship being achieved by use of coupling bars 39 as hereinabove set forth.

As can readily be seen from the above, there is achieved in accordance with the invention, the ability to fabricate precast sections 31 at a factory location where precision of alignment and placement of structural support members 33 can be achieved which is unattainable by construction methods heretofore utilized in the prior art which relied upon placement of the structural support members 33 to occur at the construction site during the construction of the chimney stack in question. Under such circumstances, the prior art methods were unable to achieve the exactness of placement and interfit of the structural support members within the concrete structure of a chimney stack as compared to the present invention since the welding and/or tieing and interfitting of structural support members 33 done in accordance with such prior art methods were done at the construction site simultaneously with the pouring of concrete, as the structure in question was being fabricated, such procedure not being capable of achieving the quality control associated with precast construction done at a factory facility applicable to the invention, nor capable of achieving the exactness of placement, interfitting and overall alignment of structural support members 33 attainable with the present invention.

In keeping with the invention and as depicted in FIG. 5, chimney stack 30 is fabricated by the physical placement, one on top of the other, of precast sections 31 constructed in accordance with the invention, and as hereinabove set forth, and the alignment of a precast section 31 with its adjacent section is achieved through the interrelationship between the structural support members 33 as herein defined. More particularly, and as illustrated in FIG. 5, the protruding portion of a structural support member 33 protrudes from the lower portion of a precast section 31, depicted as 33' in FIG. 5, downward into cavity 34 of the lower precast section 31 as therein depicted, coupling bars 39 being utilized as guide means to exactly align structural support members 33' on top of and in direct structural contact with the threaded portion of structural support members 33 which protrudes into cavity 34. In addition to providing assistance in alignment, coupling bars 39 additionally provide structural support at the point of coupling between structural support members 33 and structural support members 33' as depicted in FIG. 5. In keeping with the invention, by the utilization of the alignment technique referred to above with regard to structural support members 33, and as specifically referred to and as depicted in FIG. 5, there is achieved between structural support member 33 and structural support member 33' the optimum of quality control as well as achieving optimum in structural integrity of design related to the constructing of chimney stack 30, since virtually perfect interfit and alignment of each precast section 31 as well as virtually perfect interfit and alignment of structural support members 33 is achievable with regard to the interrelationship of each precast section 31 utilized in accordance with the invention in the fabrication and construction of chimney stack 30, the above not being achievable through the prior art techniques known to date.

In further keeping with the invention, it should additionally be noted that structural support members 33 can be fabricated within precast sections 31 as hereinabove set forth, however they can be so placed therein either under pre-tension stress or post-tension stress, thus providing additional strength of the overall structure of a particular chimney stack with the utilization of a minimum of structural support members. Furthermore, by utilization of either pre-tension or post-tension members as determined by overall design criteria of a particular chimney stack and its anticipated loading and stress requirements, there is also achieved an added degree of structural integrity to the structure in the event that the structure is exposed to unprecedented stress conditions or to unanticipated loads, thus providing inherently in the structure by utilization of the above, an added factor of safety.

In conjunction with the invention and as hereinabove set forth, precast sections 31 are assembled one on top of the other at the fabrication site as depicted in FIG. 2. Upon the placement of a precast section 31 on top of another precast section 31 and the alignment of the structural support members 33 is achieved through the utilization of coupling bars 39 as hereinabove defined, pressurized mortar 32 is injected to fill recessed cavities 34 and spacings 40 that exist between the upper portion of a precast section 31 and the lower portion of the precast section that is placed on top thereof. A sealer means 41 is placed around the joint to be filled with pressurized mortar 32 that will exist between the respective precast sections 31 prior to the injection thereof of the pressurized mortar 32 with sealer means 41 being such so as to contain within the defined area of said joint, the injected pressurized mortar 32. Additionally, sealer means 41 is also placed about the interior portion of the joint created between the respective interfit of precast sections 31 that defines flue shaft 37 so as to prevent pressurized mortar 32 from flowing into flue shaft 37.

Additionally, it is within the scope of this invention to utilize shim means 42 for placement between the respective interfitted precast sections 31 at the time of their assembly, FIG. 5, the purpose of shim 42 being to achieve exact horizontal alignment of each precast section 31 as they are stacked one on top of each other. It should be noted that it is within the scope of this invention for the utilization of any means to bond the precast sections together once they have been placed and otherwise aligned one on top of each other and that although reference has been herein made to the utilization of pressurized mortar 32, any other well known bonding means available within the prior art could also be utilized and the scope of the invention should not be considered to be restricted only to the use of pressurized mortar.

Figure 7:
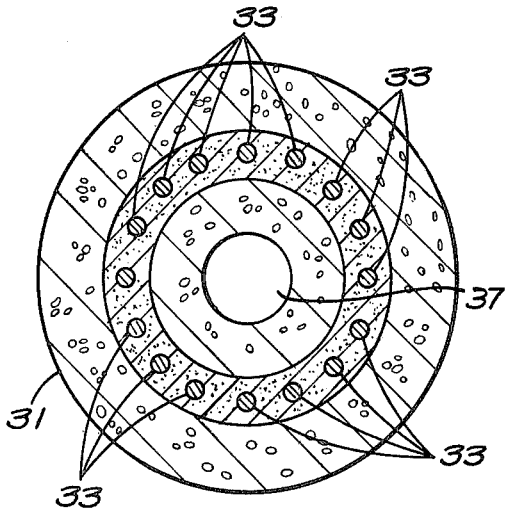
FIG. 7 is a cross sectional view of the chimney as illustrated in FIG. 1 and taken along lines 7—7.
Figure 8:
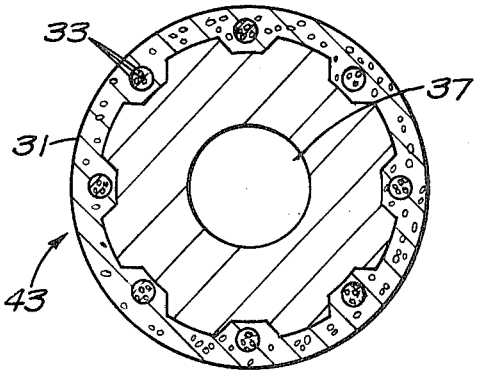
FIG. 8 is a cross sectional view of an alternative embodiment of a design that encompasses a chimney constructed in accordance with the invention.

It is additionally within the scope of this invention to utilize any structural design associated with the fabrication and construction of structures of extreme height, be they chimney stacks, towers, masts or the like. As herein preferrably embodied chimney stack 30 as depicted in FIG. 1 is circular in its overall design, FIG. 7 being a horizontal cross sectional view thereof. Although the preferred embodiment as herein described evidences a chimney stack having a circular cross sectional view as well as having structural support members 33 positioned in a circular array as depicted in FIG. 7, nothing herein contained should be considered to so limit the invention to such a cross sectional design or circular array. In further keeping with the invention, there is set forth in FIGS. 8, 9 and 10, alternative embodiments in accordance with the invention, FIG. 8 evidencing a chimney stack 43 whose cross section is circular in design and whose structural support members 33 are positioned such that they provide a symmetrical array evidencing a grouping of support members 33 at particular locations within said array.

Figure 9:
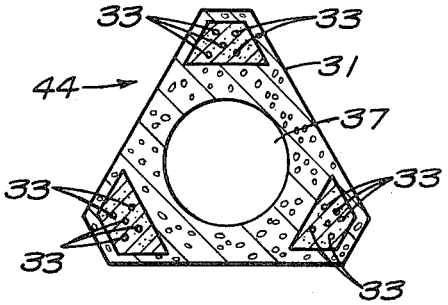
FIG. 9 is a cross sectional view of an alternative embodiment of a design that encompasses a chimney constructed in accordance with the invention.

FIG. 9 depicts another alternative embodiment of the invention evidencing a chimney stack 44 whose cross section is triangular in design and whose structural support members 33 are positioned such that they provide a symmetrical array evidencing a grouping of support members 33 at particular locations within said array.

Figure 10:
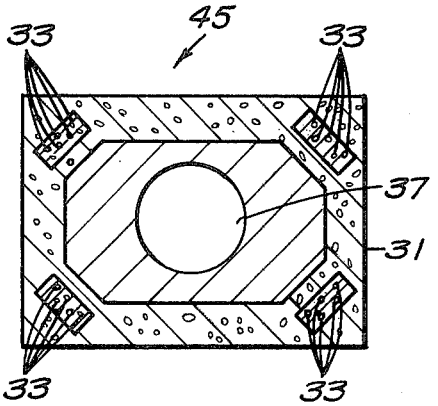
FIG. 10 is a cross sectional view of an alternative embodiment of a design that encompasses a chimney constructed in accordance with the invention.

FIG. 10 depicts another alternative embodiment of the invention evidencing a chimney stack 45 whose cross section is rectangular in design and whose structural support members 33 are positioned such that they provide a symmetrical array evidencing a grouping of support members at particular locations within said array.

It should additionally be noted that it is further within the scope of this invention to provide in the fabrication and construction of a chimney stack the ability to increase the overall height at a point in time after the initial construction of said chimney stack has been completed and its operation commenced without the need to shut down the operation and utilization of said chimney stack. As has been the case in prior situations, either as the result of governmental regulations, changing environmental circumstances or increased and/or modified utilization of a chimney stack, the increasing of the overall height thereof becomes either desirable or necessary. Under such circumstances, the prior art required the shutting down of the utilization of said chimney stack as well as extensive modifications in the design and structural make-up of said chimeny stack in order to increase its height, all of same being extremely costly, and under some circumstances either technically impossible to do or financially beyond the realm of feasibility. By utilizing the present invention, there is achieved inherent in the invention as hereinafter set forth, an inherent capability to increase the overall height of a chimney stack built in accordance with this invention without incurring the disadvantages referred to above.

Figure 6:
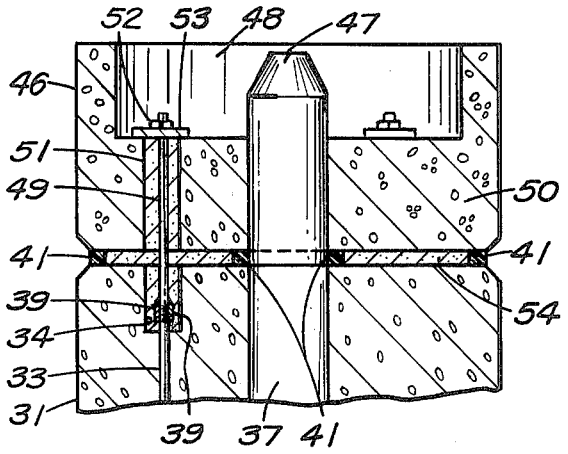
FIG. 6 is a vertical cross sectional view of FIG. 1 taken along lines 6—6 depicting a chimney cap constructed in accordance with this invention.

Reference is now herein made to FIG. 6 which depicts the top precast section 46 utilized in accordance with the invention with regard to the fabrication of chimney stack 30. As therein depicted, flue cap 47 aligns itself with flue shaft 37 hereinbefore defined as extending throughout the entire height of chimney stack 30. A recess 48 is formed within the top portion of top precast section 46 whereby structural support member 49 is coupled mechanically as herein set forth as depicted in FIG. 6 to the threaded extended portion of structural support members 33 as it protrudes within recess 34 of the top most precast section 31. In accordance with invention, after assembling the last of the precast sections 31, one on top of each other, in accordance with a particular design criteria, as herein before set forth, top precast section 46 is then set in place. Because top precast section 46 is designed to be structurally removable should there be a desire to extend the height of chimney stack 30 in the future, the design and fabrication of top precast section 46 is somewhat different from the other precast sections 31.

More particularly, the composition of material utilized to form walls 50 of top precast section 46 is identical to that utilized for walls 38 of precast sections 31 as hereinbefore set forth. However, top precast section 46 has formed within its walls 50, cylinderical cavities 51 which pass through the entire structure of wall 50 from recess 48 through to the bottom of top precast section 46, cylinderical cavities 51 coinciding with the locations of recessed cavities 34 and in direct alignment with structural support members 33 of the precast section 31 upon which top precast section 46 is placed.

In keeping with the invention, prior to the placing of top precast section 46 on top of precast section 31 as depicted in FIG. 6, structural support members 49, having coupling bars 39 affixed thereto as hereinafter set forth, are structurally affixed to structural support members 33 either by welding or other means well known in the prior art, such that structural support members 49, once structurally affixed to structural support members 33, of precast section 31, are axially aligned with structural support members 33 and upward above precast section 31. Upon completion of the above, precast section 46 is then lowered upon the upper most precast section 31 such that cylindrical cavities 51 receive and otherwise have passed through said openings structural support members 49 that are protruding above precast section 31 as hereinabove defined. By having the length of structural support members 49 sufficiently long so as to protrude in recess 48 of top precast section 46 once top precast section 46 is mounted upon precast section 31 as depicted in FIG. 6, and by having the upper portions of structural support members 49 that protrude into recess 48 threaded so as to receive nuts 52, and by the utilization of plate members 53 whose overall dimensions are greater than the cross sectional area of cylindrical cavities 51 and which have an opening formed therein whose cross section is of a sufficient size to permit structural support members 49 to pass through but which prevents nuts 52 from passing through, there is achieved a mechanical arrangement whereby top precast section 46 is structurally affixed to precast section 31 sufficient to achieve an overall structural integrity of design and operation as to chimney stack 30, but also achieving the capability in accordance with the invention of being able to remove top precast section 41 at a point in time after the fabrication of the initial structure has been completed so as to modify the overall height of chimney stack 30 either by adding additional precast sections 31, or if desired, by removing precast sections 31 from the initial structure and thereafter, remounting top precast section 46.

In actual operation, top precast section 46 is lowered into place on top of the last precast section 31 such that cylindrical cavities 51 of the top precast section 46 receive and otherwise have passed through said openings structural support members 46 that are protruding above precast section 31 after having been structurally affixed to structural support members 33 as hereinabove described.

Upon having top precast section 46 so positioned as set forth above, plate member 53 has structural support member 49 passed through the opening formed therein as well as being placed across the opening of cylindrical cavity 51 appearing within recess 48. Nut 52 is then threaded upon the threaded portion of support member 49 such that a compressed mechanical force is applied to top precast section 46 as related to the top precast section 31 of chimney stack 30 (FIG. 6), so as to provide structural means for mechanically affixing, in a detachable manner, top precast section 46 to the top precast section 31 of chimney stack 30.

In keeping with the invention, upon placement of the precast section 46 upon the top precast section 31 of chimney stack 30 and the mechanically securing of top precast section 46 to the top precast section 31 of chimney stack 30, sealer means 41 is then positioned about the outer perimeter of the joint formed between top precast section 46 and the top precast section 31 of chimney stack 30 as well as about the perimeter of said joint as defined by the location where flue cap 47 meets flue shaft 37. Injected into the spacing between top precast section 46 and the top precast section 31 of chimney stack 30 once the sections are positioned as set forth above, is any caulking compound 54 known in the prior art that is capable of providing an airtight seal between the respective precast sections as well as withstanding the operating conditions that will be experienced as to temperature, corrosion and the like. Additionally, caulking compound 54 does not form a structural bond between top precast section 46 and the top precast section 31 of chimney stack 30 so that in accordance with the invention, when the height of chimney stack 30 desires to be increased, nuts 52 are removed from structural support member 49 and top precast section 46 can then be lifted off the top of the top precast section 31 of chimney stack 30 so as to allow for the additional placement of other precast sections 31 on top of the heretofore constructed stack 30 in the manner hereinabove set forth, whereupon after the desired number of additional precast section 31 have been added, top precast section 46 is then placed upon and affixed to the top precast section 31 of chimney stack 30 in the manner hereinabove set forth.

It should be noted that upon injecting caulking compound 54 into the spacing between precast section 31 and top precast section 46 as depicted in FIG. 6, caulking compound 54 will also fill cylindrical cavity 51 and recessed cavity 34. Upon the removal of top precast section 46 from the top precast section 31 of chimney stack 30, in accordance with the invention, caulking compound 54 will need to be removed from cylindrical cavities 51, recessed cavities 34 and the surfaces upon top precast section 46 and the top precast section 31 of chimney stack 30 to which caulking compound 54 had been applied.

It should additionally be noted that upon removal of top precast section 46 as hereinabove set forth when the overall height of chimney stack 30 is desired to be altered, that under such circumstances, structural support members 49 will need to be removed from their location as affixed to structural support members 33, same to be accomplished in a manner well known in the prior art, either by cutting said structural support member 49 by use of an acetylene torch, or the like.

It should further be noted that top precast section 46 will also have placed within its precast construction structural supporting members, same being done in a manner well known in the prior art said structural supporting members however not performing the dual functions as is the case of their counterparts in precast sections 31 as hereinabove set forth in that the structural supporting members utilized in top precast section 46 are utilized solely for the purpose of adding structural integrity to top precast section 46, same do not perform the additional function of providing a means to align and otherwise couple one precast section 31 on to another precast section 31 as set forth above in accordance with the present invention.

As a result of the above, there is achieved an improved design associated with the fabrication and construction of a chimney stack or for that matter, structures of extreme height wherein precast sections are utilized having reinforcing steel members positioned therein so as to permit upon stacking of said precast sections, vertical alignment thereof such that said reinforcing steel members are positioned in vertical alignment throughout the height of the chimney so as to achieve optimum structural integrity while additionally providing the ability to modify the overall height of said chimney stack after initial construction is completed based upon modified operating conditions.

The preceding descriptions and accompanying drawings relate primarily to a specific embodiment of the invention, and the invention in its broader aspects should not be so limited to one specific embodiment as herein shown and described but departures may be made therefrom within the scope of the accompanying claims without departing from the principles of the invention and without sacrificing its chief advantages.

I claim:

1. A chimney stack fabricated from a number of precast sections, said chimney stack comprising a plurality of precast sections, each precast section being formed so as to define a centrally positioned flue shaft passing entirely therethru, said precast sections having positioned therein structural support members that have been placed under pre-tension stress prior to placement within said precast sections, said structural support members having an upper portion and a lower portion, said upper portion of said structural support members being exposed within a recess cavity formed within the upper portion of said precast section, there being a defined distance between the top of said upper portion of said structural support member and the top surface of said precast section, the lower portion of said structural support members extending beyond the lower surface of said precast sections a distance equal to said defined distance existing between the top of said upper portion of said structural support member and the top surface of said precast section such that upon placing a first precast section upon a second precast section said lower portion of said structural support member of said first precast section axially aligns with and structurally abuts said upper portions of said structural support members of said second precast section upon which said first precast section is placed, means for sealing the spacing existing between the respective precast sections as they are placed one on top of the other.

2. A chimney stack fabricated from a number of precast sections as described in claim 1 wherein the upper portion of said structural support members is threaded so as to be capable of having mechanically threaded on as well as off an eye hook so as to facilitate movement of said precast section.

3. A chimney stack fabricated from a number of precast sections as described in claim 1 wherein the lower portion of said structural support members of a precast section has coupling means structurally affixed thereto to assist in aligning said lower portion of said structural support member with its corresponding upper portion of said structural support member.

4. A chimney stack fabricated from a number of precast sections as described in claim 1 wherein shim means are utilized between the respective precast sections so as to obtain exact horizontal alignment of each of said precast sections.

5. A chimney stack fabricated from a number of precast sections as described in claim 1 wherein the horizontal cross sectional area of a precast section defines a circle.

6. A chimney stack fabricated from a number of precast sections as described in claim 1 wherein the horizontal cross sectional area of a precast section defines a rectangle.

7. A chimney stack fabricated from a number of precast sections as described in claim 1 wherein the horizontal cross sectional area of a precast section defines a triangle.

8. A chimney stack fabricated from a number of precast sections as described in claim 1 wherein said structural support members are symmetrically positioned about the vertical axis of said precast sections.

9. A chimney stack fabricated from a number of precast sections as described in claim 1 wherein said structural support members are formed to provide a symmetrical array evidencing a grouping of support members at particular locations within said array.

10. A chimney stack fabricated from a number of precast sections as described in claim 1 wherein the top precast section of said chimney stack is selectively detachable from said chimney stack so as to permit the modification of the height of said chimney stack after said chimney stack has initially been constructed.

11. A chimney stack fabricated from a number of precast sections as described in claim 1 wherein said structural support members are set in said precast sections under post-tension stress.

* * * * *